US005337448A

United States Patent [19]

Brown

[11] Patent Number: 5,337,448

[45] Date of Patent: Aug. 16, 1994

[54] METHOD OF SWINGING A PIVOTED DOOR TO A SELECTED POSITION AND CAM AND FOLLOWER MECHANISM FOR USE IN THE METHOD

[75] Inventor: Peter E. Brown, Bridgnorth, United Kingdom

[73] Assignee: Jebron Limited, West Midlands, United Kingdom

[21] Appl. No.: 979,823

[22] Filed: Nov. 19, 1992

[30] Foreign Application Priority Data

Nov. 28, 1991 [GB] United Kingdom ..... 9125322

[51] Int. Cl.[5] ..... E05F 3/10; E05F 3/22; E05F 1/08

[52] U.S. Cl. ..... 16/53; 16/55; 16/284

[58] Field of Search ..... 16/53, 55, 56, 57, 58, 16/284

[56] References Cited

U.S. PATENT DOCUMENTS

| | | | |
|---|---|---|---|
| 993,002 | 5/1911 | Voight | 16/284 |
| 2,700,175 | 1/1955 | Carlson | 16/284 |
| 3,760,455 | 9/1973 | Berry et al. | 16/53 |

FOREIGN PATENT DOCUMENTS

| | | |
|---|---|---|
| 905686 | 9/1962 | United Kingdom . |
| 925095 | 5/1963 | United Kingdom . |
| 943749 | 12/1963 | United Kingdom . |
| 1277346 | 6/1972 | United Kingdom . |
| 1279432 | 6/1972 | United Kingdom . |

*Primary Examiner*—Carmine Cuda
*Attorney, Agent, or Firm*—Webb Ziesenheim Bruening Logsdon Orkin & Hanson

[57] ABSTRACT

A door closer has a cam and follower mechanism for transmitting movement between a spring and an operating member which is connected with a door. Guide elements for the cam follower can be adjusted relative to a housing to adjust the orientation relative to the housing to which the operating member is urged by the spring.

19 Claims, 4 Drawing Sheets

METHOD OF SWINGING A PIVOTED DOOR TO A SELECTED POSITION AND CAM AND FOLLOWER MECHANISM FOR USE IN THE METHOD

BACKGROUND OF THE INVENTION

From one aspect, the present invention relates to a method of swinging a pivoted door to a selected position. It is common to equip pivoted doors with closing devices which automatically close the doors, when they are released, after being opened. In a case where there is provided a door stop which defines the closed position of the door, the door closer can be arranged to drive the door against the stop. In a case where the door is required to inhibit the spread of fire through the doorway, it is important that the closing device should reliably establish the closed position of the door.

In the case of a pivoted door which is required to swing in either one of opposite directions from a closed position, it is more difficult to ensure that the door is reliably returned to the required closed position. In the case of a pair of swinging doors having free edges which are mutually adjacent when the doors are in the closed position, it is even more important that each door should be positioned accurately by a respective closing device, particularly if the closed doors are required to form a fire barrier.

One object of the present invention is to improve the accuracy with which a door can be returned to a closed position throughout the service life of a closing device used for this purpose, to facilitate adjustment of the closed position when the door is first installed and to achieve this with a relatively small device.

SUMMARY OF THE INVENTION

According to a first aspect of the present invention, there is provided a method of swinging a pivoted door to a selected position wherein a housing is fixed with respect to a stationary structure, relative to which the door swings, a cam mounted in the housing for turning relative thereto about a cam axis is connected with the door, the cam is acted upon by a spring-loaded follower which urges the cam towards a datum orientation relative to the housing and wherein the datum orientation of the cam relative to the housing is adjusted by adjusting the position of the follower relative to the housing.

The datum orientation of the cam may be adjusted during installation of the door and may also be adjusted subsequently, in the event of changes which occur to the door and associated components during their service lives causing the door to be urged to a position which differs from the selected position or in the event of a different position being selected, for example in consequence of change to or adjustment of structure adjacent to the door.

Preferably, the housing includes guides means for guiding the cam follower for reciprocation relative to the housing and the guide means is adjusted relative to the remainder of the housing to adjust the path of the follower relative to the housing.

According to a second aspect of the invention, there is provided a cam and follower mechanism mounted in a housing wherein the cam is mounted for turning relative to the housing about a cam axis which is fixed with respect to the housing, guide means is provided for guiding the follower for reciprocation relative to the housing towards and away from the cam axis and wherein the guide means is adjustable relative to the housing in an adjustment direction transverse to the direction of reciprocation of the follower and transverse to the cam axis.

The guide means preferably comprises a pair of guide elements mounted in the housing and spaced from each other in said adjustment direction, the follower lying between the guide elements.

The guide means may include transmission means for transmitting movement between the guide elements to constrain the guide elements to move together relative to the housing.

According to a third aspect of the invention, there is provided a cam and follower mechanism mounted in a housing wherein the cam is mounted for turning relative to the housing about a cam axis and means is provided for urging the follower towards the cam axis, wherein the follower comprises a slide guided for reciprocation relative to the housing, a pair of transmission elements which occupy respective positions which are fixed with respect to the slide and a follower element which is trapped between the cam and the transmission elements and wherein the transmission elements are spaced apart in a direction transverse to the cam axis and transverse to the direction of reciprocation of the slide.

In a mechanism according to the third aspect of the invention, it is unnecessary to locate the follower element precisely in a predetermined position with respect to the slide, for example by means of an axle. The follower element can be permitted to float between the cam and the transmission elements. It is thus possible to ensure that the follower element always bears on the cam and on both of the transmission elements so that there are no clearances between the follower element and these components. This avoids play in the mechanism.

A common problem with known door closers is that, owing to variations in the dimensions of components within acceptable tolerances and/or to wear of components during the service life of a door closer, it is possible to turn an associated door through several degrees without compressing the spring of the door closer. This means that the door is free to turn through several degrees and that the position to which the door closer will return the door is not precisely defined. This is a particular disadvantage in a case where the door is required to form a fire barrier.

BRIEF DESCRIPTION OF THE DRAWINGS

An example of a door closer which includes a cam and follower mechanism according to the second aspect of the invention and which is used in a method according to the first aspect of the invention will now be described, with reference to the accompanying drawings, wherein.

Figure 1:
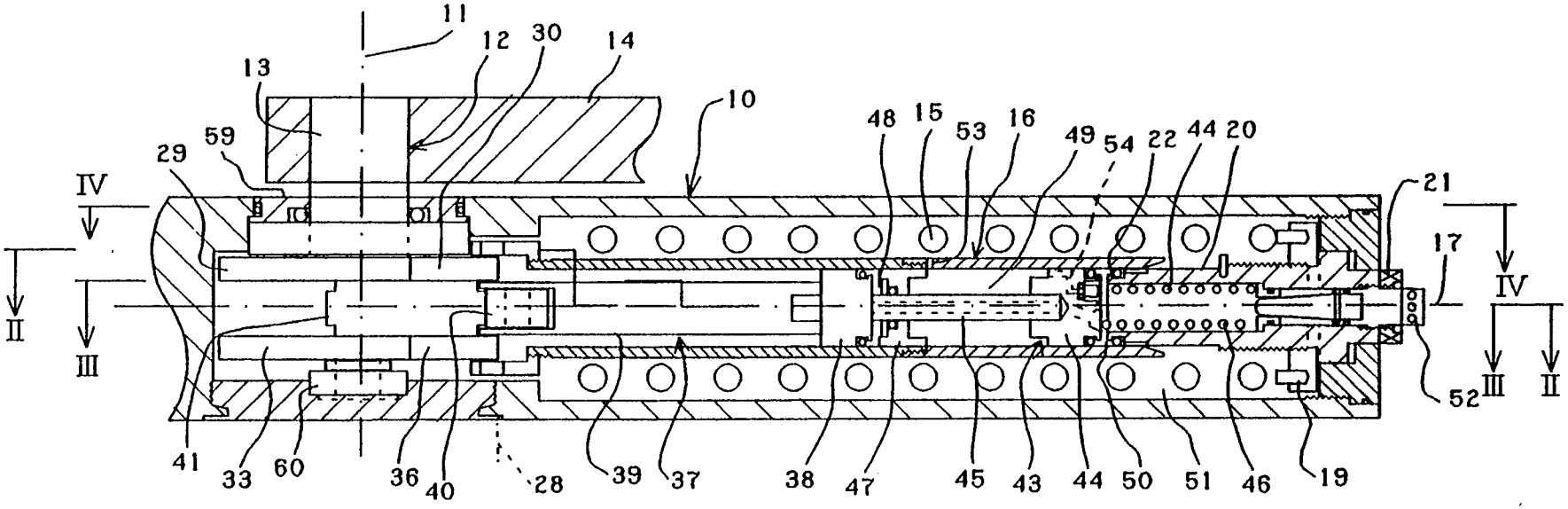
FIG. 1 shows a cross section through the door closer in a vertical plane and with an operating member of the door closer in a rest position.

The device illustrated in the accompanying drawings comprises a hollow housing 10 in which there is mounted by bearings 59, 60 for turning about an axis 11 a rotary member 12. An end portion 13 of the member 12 protrudes at the outside of the housing 10 and receives an arm 14, by means of which the rotary member 12 is connected with a door for turning with the door relative to the housing 10. Typically, the housing 10 is embedded in a floor and the door is supported for pivoting at the axis 11. The arm 14 may be attached to the bottom of the door and is typically received in a recess formed in the door. The end portion 13 is non-circular and is received in a complementary opening in the arm at one end thereof.

There is disposed inside the housing 10 a coiled compression spring 15 and a drive mechanism for transmitting motion between the spring and the rotary member 12. The drive mechanism is arranged to compress the spring 15 when the door and member 12 are turned from a rest position. The spring then urges the door and member 12 towards the rest position.

The drive mechanism includes three cam and follower mechanisms. The third cam and follower mechanism is essentially a duplicate of the first cam and follower mechanism. The followers of the first and third cam and follower mechanisms reciprocate relative to the housing 10 with a cylinder 16. The follower of the second cam and follower mechanisms reciprocates with a piston hereinafter described which slides inside the cylinder 16.

The device illustrated in the drawings is constructed to act as a damper and damp movement of the door towards the rest position under the action of the spring. It will be appreciated that, without the damping action, the door would be accelerated by the spring throughout movement towards the rest position, which would be unacceptably dangerous. In a case where the door is free to swing in either direction from the rest position, damping also enables the door to be brought to rest, when it reaches the rest position, rather than to pass through the rest position and then to oscillate about the rest position.

The cylinder 16 is mounted inside the housing 10 for reciprocation relative thereto along an axis 17 of the cylinder. The axis 17 extends centrally along the length of the housing 10 and either intersects the axis 11 or passes near to that axis. The cylinder 16 has at one end an enlarged, hollow head 18, on which there is formed a seat for one end of the spring 15. That part of the cylinder 16 other than the head 18 lies inside the spring 15. The spring extends beyond the cylinder 16 to a further seat 19, on which an end of the spring remote from the head 18 bears. The cylinder is open at both of its ends.

The seat 19 is mounted on a carrier 20 which is supported in one end portion of the housing 10 against movement outwards of the housing. The carrier 20 can turn relative to the housing about the axis 17 and a non-circular end portion 21 of the carrier protrudes from the end of the housing to facilitate turning of the carrier by means of a suitable tool. The seat 19 is annular and has a female screw thread cooperating with a male screw thread on the carrier 20. The seat 19 is restrained against turning relative to the housing by the spring 15. This may be achieved by friction between the spring and the seat. Additionally, there may be formed on the seat 19 an axially projecting lug which cooperates with the spring to prevent turning of the seat relative to the spring. Accordingly, by turning of the carrier 20 relative to the housing 10, the seat 19 can be screwed along the housing to increase or decrease the stress in the spring 15.

The carrier 20 is integral with a hollow piston 22 which slides inside the cylinder 16. The piston has an annular seal for bearing on the wall of the cylinder to establish an oil-tight relation between the piston and the cylinder. The piston 22 serves to guide the adjacent end portion of the cylinder 16 for movement relative to the housing along the axis 17.

Figure 3:
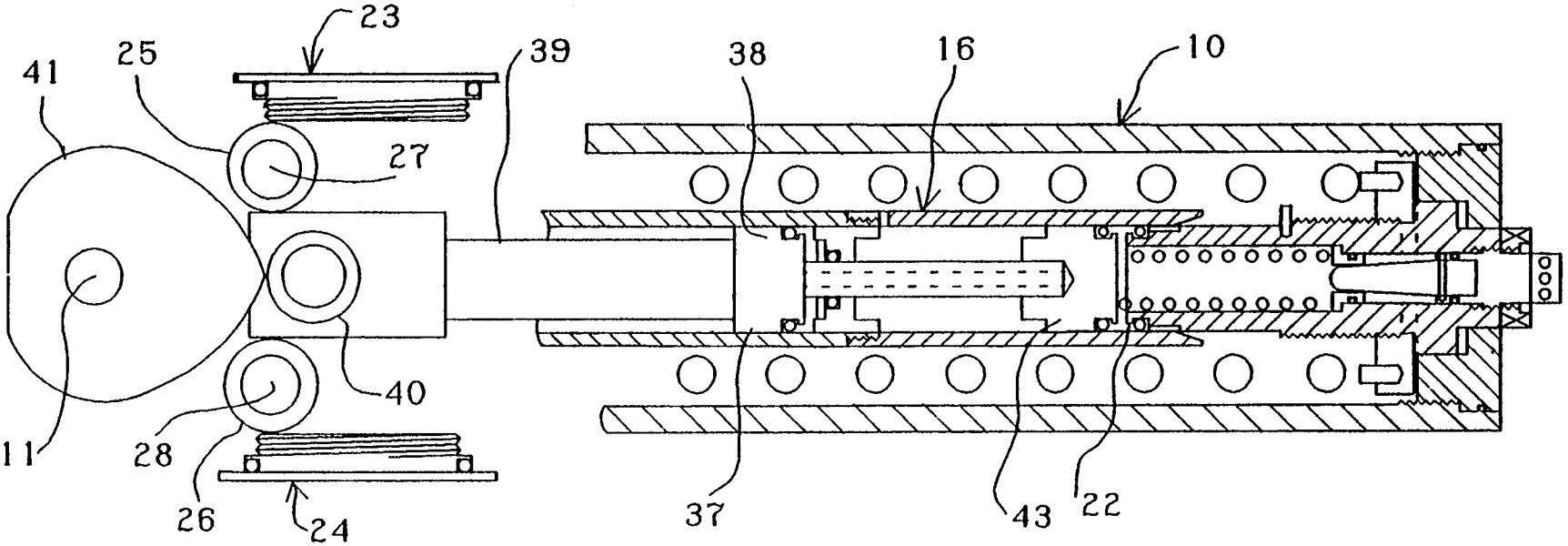
FIG. 3 is a representation similar to that of FIG. 2 of a cross section on the line III—III of FIG. 1 and FIG. 4illustrates diagrammatically certain parts of the door closer, as viewed in cross section in the plane V—V of FIG. 1.
Figure 4:
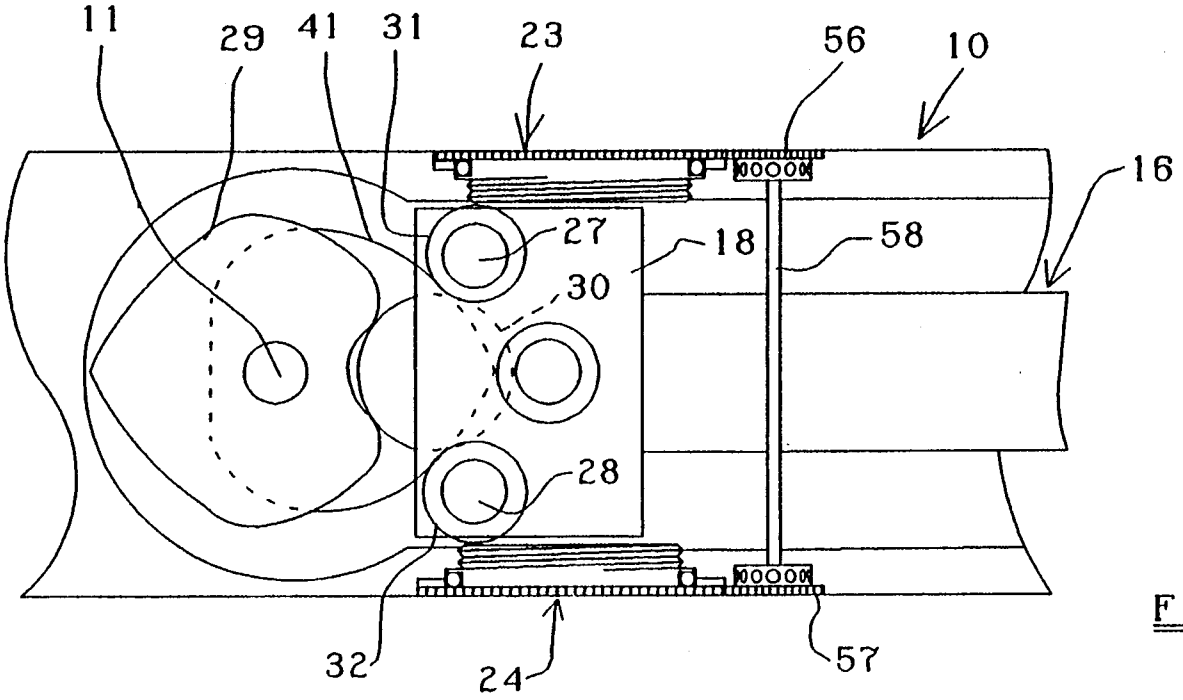

Further guide means is provided for guiding the head 18 for movement along the axis 17 relative to the housing 10. The further guide means is represented in FIG. 3 and comprises a pair of outer guide elements 23 and 24 incorporated in the housing 10 and a pair of inner guide elements 25 and 26 incorporated in the head 18 of the cylinder. The inner guide elements are formed as rollers and are mounted for free rotation relative to the head 18 about respective axes 27 and 28 which lie on opposite sides of the axis 17, are equally spaced from that axis and are perpendicular to that axis. The roller axes 27 and 28 are parallel to the axis 11. The outer guide elements 23 and 24 have respective flat, mutually parallel faces on which the rollers 25 and 26 run.

A first cam 29 lies inside the housing 10, adjacent to the cylinder head 18, and is fixed with respect to the rotary operating member 12. The cylinder 16 is provided with a cam follower for cooperating with the cam 29. In the example illustrated, the cam follower is a roller 30 which engages the periphery of the cam 29. For transmitting force between the head 18 of the cylinder and the roller 30, there is provided a pair of rollers 31 and 32 mounted for free rotation relative to the head 18 about the axes 27 and 28. Thus, the axes of the rollers 31 and 32 are fixed with respect to the cylinder 16. The roller 30 is, however, free to undergo limited movement relative to the cylinder, although the roller 30 is trapped in the head 18.

The cylinder 16 is urged towards the axis 11 by the main spring 15. Accordingly, the rollers 31 and 32 are held in firm engagement with the cam follower roller 30 and the latter roller is held in firm engagement with the first cam 29. This relationship is achieved, irrespective of manufacturing tolerances and irrespective of normal wear of components which may occur during the service life of the device.

A second cam 33, which is identical with the cam 29, is mounted in fixed relation to, but spaced along the axis 11 from, the first cam 29. The cylinder head 16 is provided with a further pair of rollers corresponding to the rollers 31 and 32 and mounted for rotation relative to the head about the axes 27 and 28 and with a further floating roller 36 corresponding to the floating roller 30, the roller 36 cooperating with the second cam and with the further pair of rollers in the same manner as that in which the floating roller 30 cooperates with the first cam and with the rollers 31 and 32.

A movable piston 37 is mounted inside the cylinder 16 for reciprocation relative thereto. The piston 37 comprises a head 38 bearing a peripheral seal which cooperates with the wall of the cylinder and a piston rod 39 extending from the head 38 in a direction towards the axis 11. The piston rod 39 passes between the guide rollers 25 and 26 and is thereby guided for movement along the axis 17. At its end remote from the head 38, the piston rod 39 carries a cam follower in the form of a roller 40. The roller 40 bears on the periphery of a cam 41 interposed between the cams 29 and 33 and fixed with respect thereto.

A third piston 43 is also mounted in the cylinder 16 for reciprocation relative thereto. The third piston comprises a head 44 bearing a peripheral seal which cooperates with the wall of the cylinder and a piston rod 45 which extends from the head 44 in a direction towards the piston 37 and the axis 11. A coiled compression spring 46, which lies mainly inside the hollow piston 22 and which protrudes therefrom to the head 44 of the piston 43 urges the piston 43 towards the piston 37 and thereby urges the piston 37 towards the axis 11. This maintains the roller 40 in engagement with the periphery of the cam 41.

The cylinder 16 contains an annular plug 47 which lies between the piston head 38 and the piston head 44. This plug is fixed with respect to the cylinder and is sealed to the cylinder. For convenience of manufacture and assembly of components of the device, the cylinder may be formed in two parts, which meet at the plug 47. The plug may be employed to connect these parts of the cylinder together. The piston rod 45 extends through the plug 47 and is sealed with respect thereto by an annular seal mounted in the plug. The plug divides a first chamber 48 in the cylinder 16, lying between the piston head 38 and the plug, from a second chamber 49 lying between the plug and the piston head 44. A third chamber 50 inside the cylinder extends from the piston head 44 to the fixed piston 22 and includes the interior of that piston. Passages are provided for the flow of oil between these chambers and the space 51 outside the cylinder 16 which contains the main spring 15.

A passage providing communication between the third chamber 50 and the space 51 contains an adjustable needle valve 52. The needle valve is screwed into a threaded bore formed in the carrier 20 and a portion of the valve protrudes at the outside of the carrier 20, so that a tool can be applied to the needle valve to adjust the degree of constriction of the flow path past the needle valve. The needle valve extends into an annular restrictor disposed in the central bore of the carrier 20. Lateral ports extend from this central bore to the space 51 at a position between the restrictor and the adjacent end of the housing 10.

A port 53 is formed in the cylinder 16 at a position between the plug 47 and the piston head 44. This port provides for relatively free flow of oil between the space 51 and the second chamber 49. A filter may be provided in the port 53 to prevent solid matter entering the cylinder. Communication between the second chamber 49 and the third chamber 50 is provided by a passage 54 formed in tile piston head 44. This passage contains a non-return valve which permits flow in a direction from the second chamber to the third chamber but prevents flow through the passage 54 from the third chamber to the second chamber.

The third chamber 50 is in communication with the first chamber 48 via passages formed in the piston head 44 and the piston rod 45, which is hollow along its entire length. A recess is formed in that face of the piston head 38 which abuts the piston rod 45, to ensure free flow between the interior of the piston rod 45 and the first chamber 48.

During manufacture of the device, the interior of the housing 10, including the interior of the cylinder 16 and of the hollow piston is charged with oil.

Figure 2:
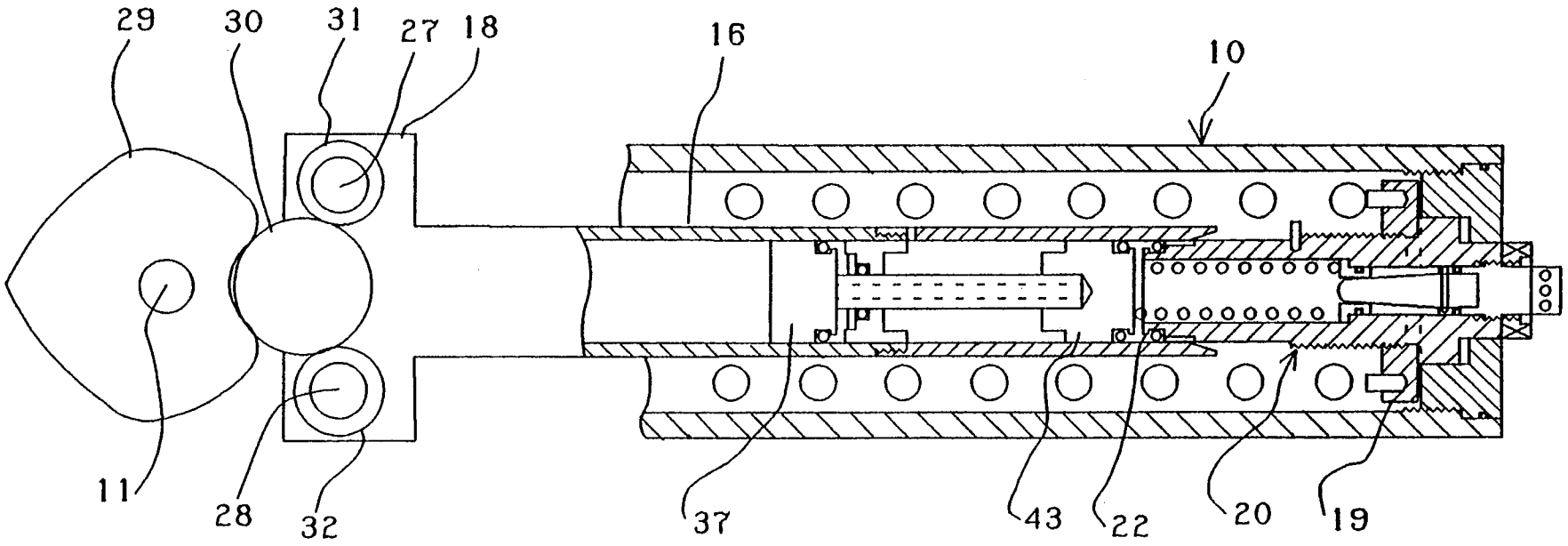
FIG. 2 is a diagrammatic representation of a cross section through the door closer along the stepped line II—II indicated in FIG. 1.

FIG. 2 illustrates the positions of the first cam 29, cylinder 16 and the pistons 22, 37 and 43, when the rotary operating member 12 is in a rest position relative to the housing 10. This is the position occupied when the main spring 15 is extended. It corresponds to the closed position of a door connected with the operating member 12. FIG. 3 illustrates the positions of the cam 41, guide rollers 25 and 26, the cylinder and the pistons also when the operating member 12 is in the rest position. When the operating member is turned from the rest position, the cam 29 drives the floating roller 30 away from the axis 11, a small, initial, angular movement of the cam causing a relatively large displacement of the roller. Since the rollers 31 and 32 are held in firm engagement with the floating roller 30 and have respective axes which are fixed with respect to the cylinder 16, the cylinder is caused to move away from the axis 11 with the floating roller 30. Turning of the cam from the rest position drives the cylinder 16 away from the axis 11 and allows the piston 37 to move towards that axis. Movement of the cylinder away from the axis 11 compresses the main spring 15.

When the associated door is released, the spring 15 drives the cylinder 16 towards the axis 11. The cam and follower mechanism transmits motion from the cylinder 16 to the operating member 12 so that the door is swung towards the rest position. Turning of the operating member towards the rest position is yieldably opposed by the damping action of the device.

As the cam 41 is turned towards the rest position, it drives the roller 40 away from the axis 11. The piston head 38 is moved towards the plug 47 so that the volume of the first chamber 48 is reduced. Oil is expelled from that chamber along the interior of tile hollow piston rod 45 to the third chamber 50. The piston 43 also is moved away from the axis 11 towards the fixed piston 22 so that the volume of the third chamber 50 also is reduced. Flow of oil from the third chamber to the second chamber 49 is prevented by the non-return valve in the passage 54. Accordingly, all of the oil expelled from the first chamber 48 and from the third chamber 50 must flow through the orifice restricted by the needle valve 52. Closing movement of the door is thereby controlled.

The shape of the cam 29 is selected to provide that the action of the floating roller 30 on the cam, when the operating member 12 is in the rest position, is a strong centring action, driving the cam to and holding the cam in the rest position. The orientation of the cam relative to the housing 10, when in the rest position, can be adjusted through a small range by adjusting the outer guide elements 23 and 24 in a direction transverse to the axis 11.

Each of the outer guide elements 23 and 24 is formed with a male screw thread and is screwed into a threaded opening in the housing 10. The guide elements are screwed towards each other until they are in firm engagement with respective ones of the guide rollers 25 and 26. The outer guide elements may be set in positions such that the axis 17 intersects the axis 11. Alternatively, both guide elements may be moved in the same direction relative to the housing to shift the axis 17 to one side of the axis 11 and thereby adjust the rest position of the operating member 12. To facilitate adjustment, each of the outer guide elements may be adapted to receive a tool. For example, a slot may be formed in the face of the guide element which is exposed at the outside of the housing 10. However, in the example illustrated in the drawings, transmission means is provided for transmitting rotary drive to both of the outer drive elements concurrently. The transmission means includes a sprocket 56 mounted in the body adjacent to the guide element 23 and having teeth meshing with teeth formed at the periphery of the guide element. A corresponding sprocket 57 is mounted in the body adjacent to the guide element 24. Each of the sprockets includes a hub in which there are formed a number of radial bores for receiving a bar or other tool, by means of which the sprocket can be turned relative to the housing. There is in the housing an opening which permits access to a part of the hub of each sprocket. The sprockets 56 and 57 have a common axis and are connected together by a shaft 58 which extends across the housing 10. The sprockets are fixed on opposite end portions of the shaft 58 so that the sprockets are constrained to turn with the shaft.

The shaft 58 is maintained under torsional stress. This stress tends to turn the outer guide elements 23 and 24 in respective directions corresponding to screwing of the guide elements towards each other. Accordingly, the guide elements exert pressure on the guide rollers 25 and 26. The reaction to this pressure resists the turning moment exerted on the sprockets 56 and 57 by the shaft 58. The guide rollers 25 and 26 maintain between the outer guide elements 23 and 24 a separation which is greater than the separation between the guide elements when the shaft 58 is unstressed.

The device herein before described may be modified by the provision of levers on the outer guide elements 23 and 24 to facilitate turning of these elements relative to the housing 10. In a case where there is provided on each of the outer guide elements a respective lever or other means to facilitate turning of the guide element, the sprockets 56 and 57 and the shaft 58 may be omitted.

I claim:

1. A cam and follower mechanism mounted in a housing, comprising:

a cam mounted for turning relative to said housing about a cam axis fixed relative to said housing;

a follower in abutment with said cam; and guide means for guiding said follower for reciprocation relative to said housing towards and away from said cam axis, said guide means being adjustable relative to said housing in an adjustment direction transverse to a direction of reciprocation of said follower and transverse to said cam axis, wherein said guide means comprises a plurality of guide elements mounted in the housing and spaced apart from each other in said adjustment direction and wherein said follower lies between said guide elements, wherein said guide means includes transmission means for transmitting movement between said guide elements to constrain said guide elements to move together relative to said housing, wherein each of said guide elements has a screw thread engaged with a respective complementary thread of said housing, and wherein said transmission means includes a respective rotary drive element engaged with each guide element and an intermediate rotary transition element located between said rotary drive elements for constraining said rotary drive elements to turn together relative to said housing.

2. A mechanism according to claim 19 wherein said intermediate transition element is stressed in torsion, said follower maintaining between said guide elements a separation which is greater than the separation between said guide elements when said guide means is unstressed.

3. A method of swinging a pivoted door to a selected position comprising the steps of fixing a housing with respect of a stationary structure, relative to which structure the door swings, connecting with the door a cam which is mounted in the housing for turning relative thereto about a cam axis, urging the cam towards a datum orientation relative to the housing by meáns of a spring-loaded follower element acting on the cam, wherein the follower element is trapped between the cam and a pair of transmission elements and further comprising the step of adjusting the position of the follower element by adjusting the respective positions of the transmissions elements relative to the housing, thereby adjusting the datum orientation of the cam relative to the housing.

4. A cam and follower mechanism mounted in a housing, wherein the cam is mounted for turning relative to the housing about a cam axis which is fixed relative to the housing, guide means is provided for guiding the follower for reciprocation relative to the housing towards and away from the cam axis, wherein the guide means comprises an elongated member having first and second end portions at respective opposite ends of the member and having the follower at said first end portion, there are further provided guide elements which cooperate with said first end portion of said member for guiding said first end portion for reciprocation relative to the housing and a further guide part for restraining movement of said second end portion of said member relative to the housing except movement towards and away from the cam and wherein said guide elements are adjustable relative to the housing in an adjustment direction transverse to the direction of reciprocation of the follower and transverse to the cam axis.

5. A mechanism according to claim 4 wherein the follower lies between the guide elements.

6. A mechanism according to claim 4 wherein at least one of said guide elements has a screw thread cooperating with a complementary thread of the housing.

7. A mechanism according to claim 5 wherein the guide means includes transmission means for transmitting movement between the guide elements to constrain the guide elements to move together relative to the housing.

8. A mechanism according to claim 7 wherein each guide element has a screw thread engaged with a respective complementary thread of the housing and wherein the transmission means comprises a respective rotary drive element engaged with each guide element and an intermediate, rotary transmission element for constraining the rotary drive elements to turn together relative to the housing.

9. A mechanism according to claim 5 wherein the follower maintains between the guide elements a separation which is greater than the separation between the guide elements when the guide means is unstressed, so that the guide means is under continuous stress.

10. A mechanism according to claim 8, wherein the intermediate transmission element is stressed in torsion, the follower maintaining between the guide elements a separation which is greater than the separation between the guide elements when the guide means is unstressed.

11. A mechanism according to claim 4 wherein the follower includes a pair of transmission elements and a follower element which is trapped between the cam and the transmission elements.

12. A mechanism according to claim 11 wherein the follower element is a roller.

13. A mechanism according to claim 11 wherein the transmission elements are rollers and are mounted for rotation relative to the housing about respective axes which are fixed with respect to each other but which are movable relative to the housing when the follower moves.

14. A cam and follower mechanism mounted in a housing, comprising a cam, said cam rotatably mounted for turning relative to the housing about a cam axis, a follower, means for urging the follower towards the cam axis, wherein the follower comprises a slide, means for guiding the slide for reciprocation relative to the housing, a pair of transmission elements disposed within the housing which occupy respective positions which are fixed with respect to the slide and a follower element trapped between the cam and the transmission elements and wherein the transmission elements are spaced apart in a first direction , said first direction being transverse to the cam axis and transverse to the direction of reciprocation of the slide.

15. A mechanism according to claim 14 wherein the transmission elements are rollers mounted for rotation relative to the slide about respective axes which are fixed with respect to the slide.

16. A mechanism according to claim 14 wherein tile follower element is a roller.

17. A door closer comprising a mechanism according to claim 4.

18. A door closer comprising a mechanism according to claim 5.

19. A method of swinging a pivoted door to a selected position comprising the steps of fixing a housing with respect of a stationary structure, relative to which structure the door swings, connecting with the door a cam which is mounted in the housing for turning relative thereto about a cam axis, urging the cam towards a datum orientation relative to the housing by means of a spring-loaded follower acting on the cam, guiding the follower between a pair of guide elements and the step of adjusting the guide elements together relative to the housing, thereby adjusting the datum orientation of the cam relative to the housing by adjusting the position of the follower.

* * * * *

UNITED STATES PATENT AND TRADEMARK OFFICE

CERTIFICATE OF CORRECTION

PATENT NO. : 5,337,448

DATED : August 16, 1994

INVENTOR(S) : Peter E. Brown

It is certified that error appears in the above-indentified patent and that said Letters Patent is hereby corrected as shown below:

Column 1 Line 57 "guides" should read --guide--.

Column 2 Line 66 "4illustrates" should read --4 illustrates--.

Column 5 Line 52 "tile" should read --the--.

Column 6 Line 32 "tile" should read --the--.

Claim 2 Line 65 Column 7 "19" should read --1--.

Claim 3 Line 15 Column 8 "transmissions" should read --transmission--.

Claim 14 Line 22 Column 9 "direction ," should read --direction,--.

Claim 16 Line 5 Column 10 "tile" should read --the--.

Signed and Sealed this

Twenty-fifth Day of October, 1994

*Attest:*

*Attesting Officer*

Bruce Lehman

BRUCE LEHMAN

*Commissioner of Patents and Trademarks*